US008592668B1

(12) United States Patent
Kamimoto

(10) Patent No.: US 8,592,668 B1
(45) Date of Patent: Nov. 26, 2013

(54) WOLF NOTE ELIMINATION DEVICE FOR A STRINGED INSTRUMENT

(76) Inventor: Hideo Kamimoto, San Jose, CA (US)

( * ) Notice: Subject to any disclaimer, the term of this patent is extended or adjusted under 35 U.S.C. 154(b) by 0 days.

(21) Appl. No.: 13/397,519

(22) Filed: Feb. 15, 2012

(51) Int. Cl.
*G10D 3/02* (2006.01)

(52) U.S. Cl.
USPC ..... 84/294; 84/453

(58) Field of Classification Search
USPC ..... 84/294
See application file for complete search history.

(56) References Cited

U.S. PATENT DOCUMENTS 2,444,280 A 6/1948 Burhans
4,173,165 A * 11/1979 Rhodes ..... 84/311
5,883,318 A * 3/1999 Deutsch ..... 84/295
5,889,222 A 3/1999 Burgess
6,515,209 B2 2/2003 Pittman
6,861,581 B2 3/2005 Geiger
7,259,308 B2 8/2007 Geiger
7,687,695 B2 3/2010 DeJule
2007/0095194 A1 5/2007 Moerth
2010/0263521 A1 * 10/2010 Ierymenko et al. ..... 84/726

* cited by examiner

*Primary Examiner* — Christopher Uhlir
(74) *Attorney, Agent, or Firm* — Theodore J. Bielen, Jr.

(57) ABSTRACT

A wolf note elimination device for a stringed instrument utilizing a base member which is attachable to the surface of the stringed instrument. An adjuster in the form of a plate slidingly mounts to the base. The slidable plate terminates on one end with two blades having weights. The blades are cantilevered from the base. The other end of the plate extends from the base and contacts an adjuster which exerts a force on the plate to effect sliding of the same relative to the base.

16 Claims, 3 Drawing Sheets

WOLF NOTE ELIMINATION DEVICE FOR A STRINGED INSTRUMENT

BACKGROUND OF THE INVENTION

The present invention relates to a novel and useful device that is intended to cancel or eliminate wolf notes, which are inherent to stringed instruments, such as cellos, violins, and the like.

A wolf note typically appears in a stringed instrument and is determined by the main body resonance of such instrument. Thus, a wolf note typically appears when a player sounds a note which is close to the main body resonance of the instrument. At this point, the pitch of the string being played will interact with the pitch of the body resonances and the pitch of the string will shift a small distance from the intended note. At the same time, the frequency of the main body resonance of the instrument will also shift in the opposite direction away from the intended notes. The wolf note is disagreeable or unpleasant and resembles a warbling or shuddering sound. Specifically, the pitch of the note being played splits into two separate notes, beating together in frequency at a rate up to 10 hertz or more. Such wolf note interaction is most noticeable in instruments in the violin family.

For example, the wolf note is most pronounced on the cello, and is more difficult to control. Most cellos have a wolf note that appears between the D and G notes, with the predominate frequency centered in the range between E and F sharp. The wolf note is especially troublesome on the G string and most attempts to control the wolfe note phenomenon have been directed towards this string. However, the wolfe note is also prominent on the C string and can also, occasionally, appear on the D string.

Prior attempts to control wolf notes have entailed attaching weights to the top of the instruments, wedging material between the tail piece and the top of the instrument and the like. Although such methods are partially successful, they have not completely eliminated the wolf note. Also, prior methods have reduced the overall amplitude and tone quality of the instruments, such as cellos.

The existence of wolf notes have been recognized and prior art devices and apparatuses have been proposed to alter the acoustic output of stringed instrument. For example, U.S. Pat. No. 5,889,222 describes a device which includes an adjustable calibrated weight which is a fixed to a body of the instrument to adjust the tone and feel of such instrument.

U.S. Pat. Nos. 6,515,209, 6,861,581, and 7,259,308 show additional components which are attached to guitars to enhance frequency responds and control resonance of the same.

United States Patent Publication 2007/0095194 shows a collet chuck in two parts which is applied axially to a string of a stringed instrument to eliminate wolf notes.

U.S. Pat. No. 2,444,280 teaches a device for suppressing objectionable tones in the violin family that utilizes a support member which attaches to the tail piece of the stringed instrument and includes a screw having a rubber tip which is forced against the top surface of the instrument.

U.S. Pat. No. 7,687,695 utilizes a resonator which fits onto both sides of the stringed instrument body and includes dampeners to control a particular note of the string instrument.

Japanese Patent Publication 2011095710 shows a device for controlling wolf tones which utilizes a piezoelectric material. The circuitry involved consumes the electric resonance generated by a wolf note.

A simple device for controlling wolf notes in stringed instruments which is easily employed and is easily positioned on the instrument would be a notable advance in the musical arts.

SUMMARY OF THE INVENTION

In accordance with the present invention a novel and useful device for eliminating wolf notes in stringed instruments is herein provided.

The device of the present invention utilizes a base member which may be in the form of a block of rigid or semi-rigid material such as wood, plastic, and the like. The base member is capable of being attached to the surface of the stringed instrument by the use of a removable adhesive, such as an adhesive known as Museum Wax.

The device of the present invention also is fashioned with a resonant assembly system. The resonant assembly system includes a pair of resonant assembly units. Each resonant assembly unit is formed from a plate that is slidably mounted at or to the base. The plate includes a first end portion and a second end portion, the former part being of the first and second resonant assembly units. The plate, thus, exists in the form of a forked member having a first end portion that includes first and second blades of the first and second resonant assembly units, respectively. First and second protuberances or saddles extend from the base and contact the first and second blades of the first and second resonant assembly units. In this manner, the first and second blades of the first and second resonant assembly units, respectively, cantilever outwardly from the base.

The slidable plate also a second end portion interacts with an adjuster which moves the second end portion toward and from the base. Needless to say, the first and second resonant assembly units are also moved relative to the base by the action of the adjuster. In certain cases, the adjuster may include a threaded shaft that threadingly engages the second end portion of the plate. The threaded shaft also possess a portion which engages the base and is confined for rotation relative to the base.

Each resonant unit is also constructed with a weight that is attached to the blades of each resonance assembly unit. The combination of the stiffness of each blade, the length of each blade and the size of the attached weight determines the resonance frequency of each assembly unit. In addition, the weight may be attached to any of the vibrating blades using damping items, such as elastomeric fasteners, to broaden the frequency response of the resonance frequency assembly.

Further, the device of the present invention may be formed with a guide which may take the form of a U-shaped cover of plastic material. The U-shaped cover is fastened to the base member by gluing and the like, but permits the plate to slide between the base member and the U-shaped channel during movements effected by the adjuster.

It may be apparent that a novel and useful wolf note elimination device has been hereinabove described.

It is therefore an object of the present invention to provide a wolf note elimination device which is useable on stringed instruments such as those of the violin family.

Another object of the present invention is to provide wolf note elimination device which may be employed to eliminate a wolf note on stringed instruments without noticeably reducing the overall amplitude and tone quality of the instrument.

A further object of the present invention is to provide a wolf note elimination device which is easily adjusted for environmental changes and factors which effect the main body resonance of the stringed instrument.

Another object of the present invention is to provide a wolf note elimination device which is removably applied to the surface of the stringed instrument and may be repositioned following adjustment of the same to cancel a wolf note.

Yet another object of the present invention is to provide a wolf note elimination device which is usable on a cello and is adjustable due to changes in the position in the wolf note according to the season, weather, or other maintenance and set up factors with respect to such cello.

Another object of the present invention is to provide a wolf note elimination device that employs dual resonant assemblies to respond the frequency range of the wolf note countered by the device of the present invention.

The invention possesses other objects and advantages especially as concerns particular characteristics and features thereof which will become apparent as the specification continues, and should be taken in conjunction with the following drawings illustrating embodiments of the invention.

Figure 1:
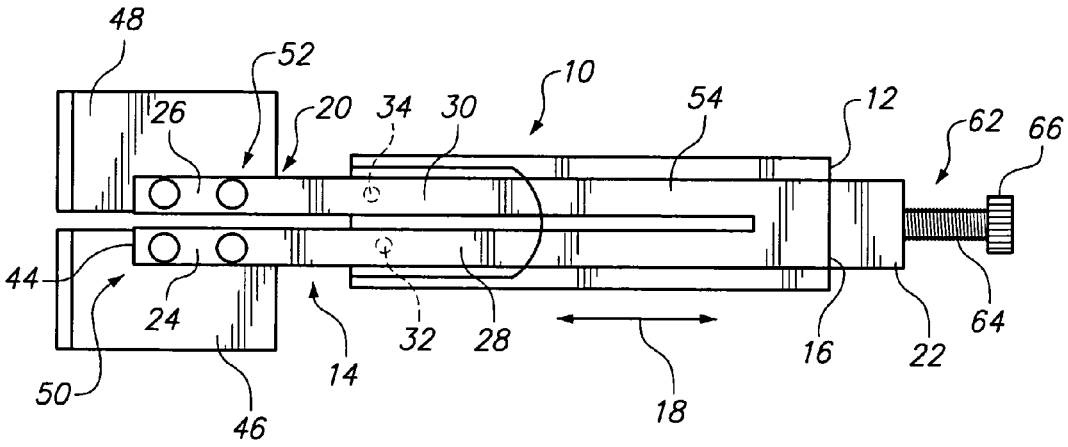
FIG. 1 is a top plan view of the device of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole is shown in the drawing by reference character 10, device 10 is intended to eliminate wolf notes in stringed instruments, such as instruments in the violin family, including cellos. Device 10 includes as one of its elements a base 12, FIGS. 1 and 2. Base 12 may be formed of any suitable rigid or semi-rigid material such as wood, plastic, and the like. Base 12 is depicted in the drawings as a rectangular solid.

A resonance assembly system 14 is also included in the present invention. Resonance assembly system 14 is constructed with a slidable plate 16 which is capable of moving relative to base 12 according to directional arrow 18, FIGS. 1, 2, and 5. Plate 16 includes a first end portion 20 which is forked. Also, slidable plate 16 possesses a second end portion 22 which is L-shaped. First end portion 20 of slidable plate 16 is formed into resonance assembly units 24 and 26. Resonance assembly units 24 and 26 include blades 28 and 30, respectively. Slidable plate 16 and, thus, blades 26 and 28 may be formed of spring steel. Blades 26 and 28 are intended to vibrate, the acoutic properties of which are determined by the material, length, width, and thickness of each blade 26 and 28.

Figure 2:
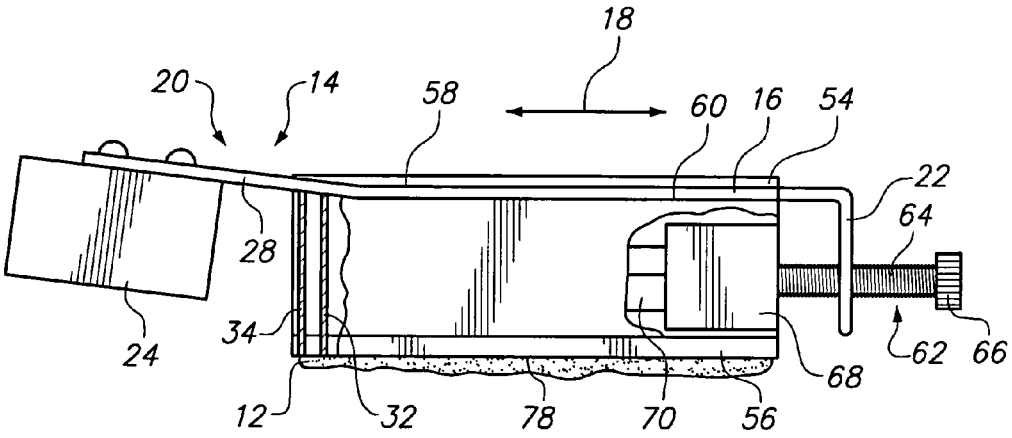
FIG. 2 is a side elevational view of the device of the present invention with broken away portions depicting the blade adjustment threaded members and the portions of the adjuster internal to the base member.
Figure 3:
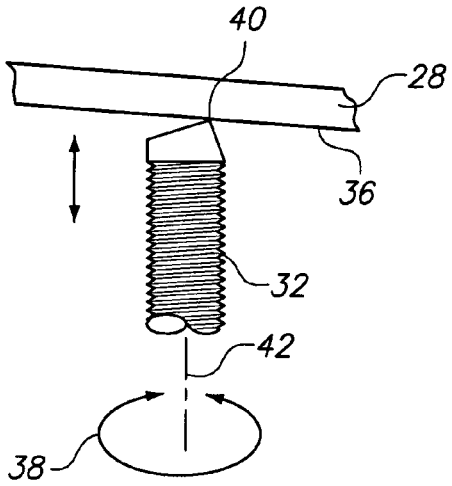
FIG. 3 is a side elevational schematic view of a blade adjustment member in one position.
Figure 4:
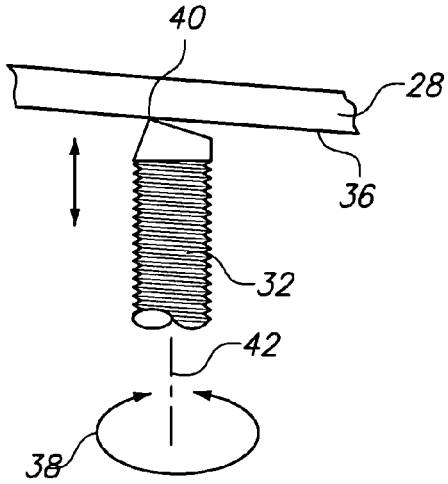
FIG. 4 is a side elevational schematic view of the blade adjustment member in another orientation.

With reference to FIGS. 2, 3, and 4, it may be seen that threaded protuberances or saddles 32 and 34 extend through base 12 and contact the lower surfaces of blades 28 and 30. With respect to FIGS. 3 and 4, threaded protuberance or adjustment screw 32 is depicted in contact with the lower surface 36 of blade 28 (shown partially). Directional arrow 38 indicates the turning movement of threaded protuberance 32. It should be seen that the tip 40 of adjustment screw 32 lies apart from axis 42. Thus, the turning of tip 40 provides a large degree of control of the contact point of tip 40 to bottom surface 38 and, consequently, greatly adjusts the cantilever of blade 28 between adjustment screw 32 and the end 44, FIG. 1, of blade 28. Such adjustment, thus, determines the vibrating frequency of blade 28. Of course, the same relationship exists with respect to blade 30 and threaded protuberance or adjustment screw 34.

Weights 46 and 48 are attached to blades 28 and 30 by the use of screws 50 and 52, respectively. The size and mass of weights 46 and 48 are chosen dependent on the resonance frequency desired with respect to a particular instrument. Those depicted in the drawings are indicated to be used with a cello which will be hereinafter described in greater detail. In order to broaden the frequency response of blades and weights 28, 30, 46, and 48, elastomeric members, such as rubber 0-rings, may be threaded onto any of the screws 50 and 52 on either side of the resonance blade 28 and 30. Such use of elastomeric members also provides a controlled amount of damping.

U-shaped plastic channel 54 is also depicted in FIGS. 1 and 2 as being a transparent body. Channel 54 overlies slidable plate 16 and base 12. However, U-shaped plastic channel 54 is attached only to the sides 56 and another, not shown, of base 12. A space 58 is formed between U-shaped channel 54 and the top 60 of base 12 to allow plate 16 to slide according to directional arrow 18.

Second end portion 22 of slidable plate 16 extends from base 12. An adjuster 62 takes the form of a screw 64 having a thumb grip 66. Screw 64 threadingly engages second end portion 22 and extends through a spacer 68 within base 12. A nut 70 forms the termination of screw 66, such that nut 70 is confined to the interior of base 12 between spacer 56 and the body of base 12.

Figure 5:
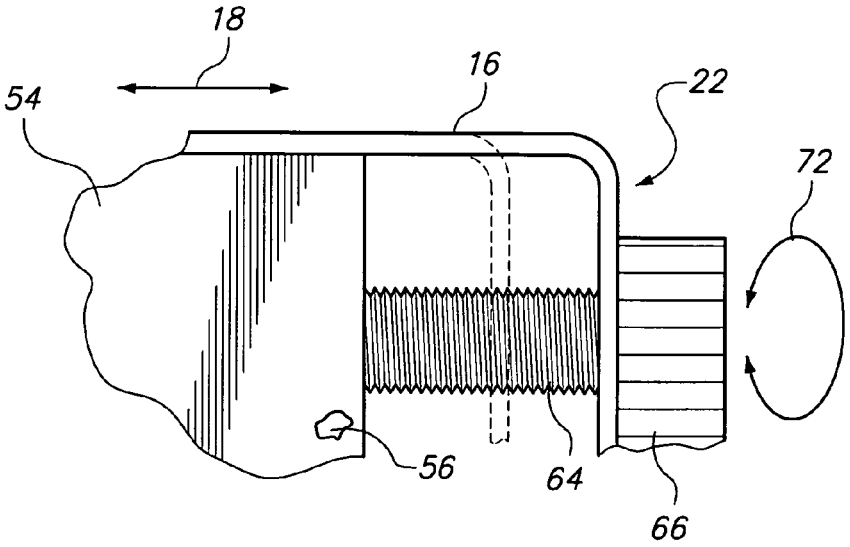
FIG. 5 is an enlarge side elevational view of a portion of the adjuster used to move the slidable plate of the resonance assembly system.

The turning of thumb grip 66, directional arrow 72, FIG. 5, will move plate 16 according to directional arrow 18, back and forth as desired. Thus, the cantilever extension of weights 46 and 48 connected to blades 28 and 30, respectively, is extended or contracted according to the turning of thumb screw 66.

Figure 6:
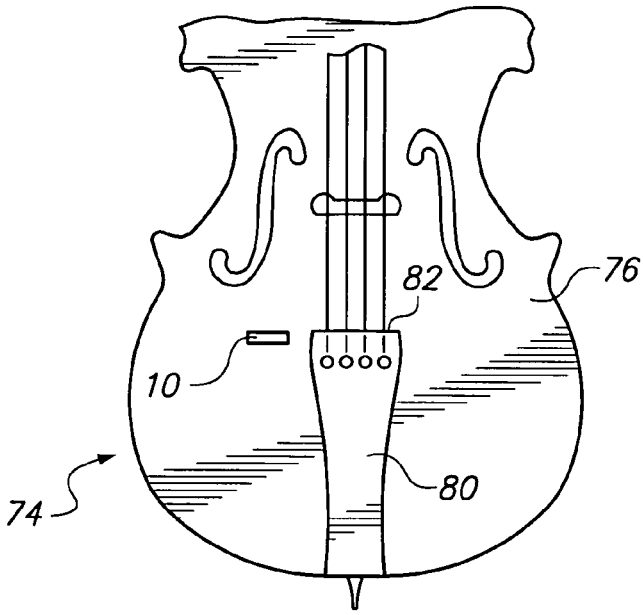
FIG. 6 is a top plan schematic view of a portion of a cello showing the initial position of the device of the present invention.
Figure 7:
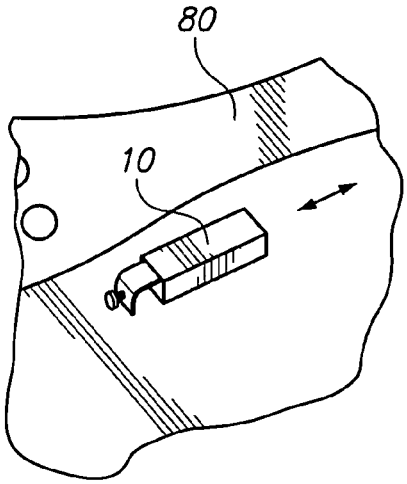
FIG. 7 is a top isometric view of a portion of the cello of FIG. 6, showing the device being repositioned following resonance adjustment.
Figure 8:
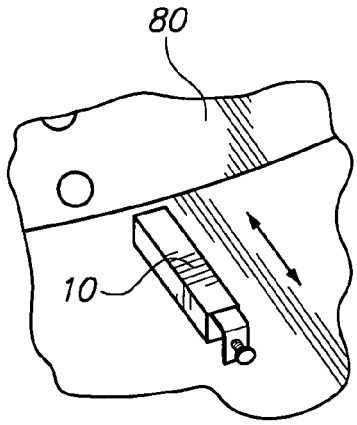
FIG. 8 is a partial isometric view showing the device of the present invention in a repositioned mounting following adjustment of the device.

In operation, the characteristics of blades 28 and 30 as well as connected weights 46 and 48 are determined concomitant with the resonance frequency desired with respect to a particular stringed instrument. Each resonant assembly is tuned to a slightly different frequency to cover the frequency range of the wolf note in question. With reference to FIG. 6, a Cello 74 is depicted in part. Device 10 is then attached to the top surface of exemplary Cello 74 by the use of removable adhesive layer 78, FIG. 2. Initially, the device 10 is placed a small distance away from the tailpiece 80 and substantially even with the upper end 82 thereof. After locating device 10, the precise position of the wolf note with respect to a particular string, typically the G-string on a cello is determined. In certain cases, the wolf note may be located between the D and G strings on a cello. By playing the particular string and observing the severity of the wolf note, device 10 may be tuned by using adjuster 62 to move plate 16 in either direction, until the wolf note diminishes and disappears. By this process, device 10 is tuned to the exact frequency needed to eliminate the wolf note. Once success has been achieved in eliminating the wolf note, device 10 may be moved to the positions shown in FIGS. 7 and 8., which are considered to be less noticeable. In certain cases, device 10 may be attached to various parts of stringed instruments, such as guitars, electric bases, and the like to control desirable notes.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A wolfe note elimination device for a stringed instrument comprising:

a. a base member;

b. a resonant assembly system, said resonant assembly system comprising a plate slidably mounted at said base, said plate including a first end portion and a second end portion, said plate first end portion terminating in a first resonant assembly unit comprising a first blade, and a second resonant assembly unit comprising a second, blade, said first blade being separated from said second blade, a first protuberance supported by and extending from said base member, said first protuberance contacting said first blade, a second protuberance supported by and extending from said base member, said second protuberance contacting said second blade; and c. an adjuster, said adjuster determining a relative position between said base and said plate, said adjuster interacting with said second end portion of said plate.

2. The device of claim 1 in which said adjuster includes a threaded shaft threadingly engaging said second end portion of said plate, said threaded shaft including a portion engaging said base and being confined for rotation relative to said base.

3. The device of claim 1 which additionally comprises a guide for directing the relative movement between said base and said plate.

4. The device of claim 3 in which said adjuster includes a threaded shaft threadingly engaging said second end portion of said plate, said threaded shaft including a portion engaging said base and being confined for rotation relative to said base.

5. The device of claim 1 in which said resonant assembly system additionally comprises at least one weight, said at least one weight being fixed to said first or second blades of said first and second resonant assembly units, respectively.

6. The device of claim 5 in which said adjuster includes a threaded shaft threadingly engaging said second end portion of said plate, said threaded shaft including a portion engaging said base and being confined for rotation relative to said base.

7. The device of claim 5 which additionally comprises a guide for directing the relative movement between said base and said plate.

8. The device of claim 7 in which said adjuster includes a threaded shaft threadingly engaging said second end portion of said plate, said threaded shaft including a portion engaging said base and being confined for rotation relative to said base.

9. The device of claim 1 in which said first and second protuberances each comprises elongated members extending along an axis, at least one of said first and second protuberances including a tip, said tip lying apart from said axis of said at least one of said first and second protuberances.

10. The device of claim 9 in which said adjuster includes a threaded shaft threadingly engaging said second end portion of said plate, said threaded shaft including a portion engaging said base and being confined for rotation relative to said base.

11. The device of claim 9 which additionally comprises a guide for directing the relative movement between said base and said plate.

12. The device of claim 11 in which said adjuster includes a threaded shaft threadingly engaging said second end portion of said plate, said threaded shaft including a portion engaging said base and being confined for rotation relative to said base.

13. The device of claim 9 in which said resonant assembly system additionally comprises at least one weight, said at least one weight being selectively fixed to said first or second blades of said first and second resonant assembly units, respectively.

14. The device of claim 13 in which said adjuster includes a threaded shaft threadingly engaging said second end portion of said plate, said threaded shaft including a portion engaging said base and being confined for rotation relative to said base.

15. The device of claim 13 which additionally comprises a guide for directing the relative movement between said base and said plate.

16. The device of claim 15 in which said adjuster includes a threaded shaft threadingly engaging said second end portion of said plate, said threaded shaft including a portion engaging said base and being confined for rotation relative to said base.

* * * * *